US009439515B2

(12) United States Patent
Kim

(10) Patent No.: US 9,439,515 B2
(45) Date of Patent: Sep. 13, 2016

(54) SLIDING DEVICE, BABY CARRIER, KNAPSACK, BAG, AND BELT BAG

(76) Inventor: Joung Soo Kim, Incheon (KR)

( * ) Notice: Subject to any disclaimer, the term of this patent is extended or adjusted under 35 U.S.C. 154(b) by 686 days.

(21) Appl. No.: 13/382,935

(22) PCT Filed: Nov. 22, 2010

(86) PCT No.: PCT/KR2010/008247

§ 371 (c)(1),
(2), (4) Date: Jan. 9, 2012

(87) PCT Pub. No.: WO2011/078484

PCT Pub. Date: Jun. 30, 2011

(65) Prior Publication Data

US 2012/0111904 A1 May 10, 2012

(30) Foreign Application Priority Data

Dec. 21, 2009 (KR) ..... 10-2009-0127839
Feb. 23, 2010 (KR) ..... 10-2010-0015975

(51) Int. Cl.

| | |
|---|---|
| ***A61G 5/00*** | (2006.01) |
| ***A61G 1/00*** | (2006.01) |
| ***A45F 5/00*** | (2006.01) |
| ***A45F 3/04*** | (2006.01) |
| ***A45C 1/04*** | (2006.01) |

(Continued)

(52) U.S. Cl.

CPC ..... *A47D 13/025* (2013.01); *A45F 3/04* (2013.01); *A45F 3/14* (2013.01); *A45F 4/02* (2013.01); *A45F 2003/144* (2013.01); *Y10T 24/2561* (2015.01)

(58) Field of Classification Search

CPC ..... A47D 13/025
USPC ..... 224/160, 158, 159, 195, 657, 660; 24/415

See application file for complete search history.

(56) References Cited

U.S. PATENT DOCUMENTS 5,205,450 A * 4/1993 Derosier ..... 224/161
5,361,952 A * 11/1994 Gold ..... 224/159

(Continued)

FOREIGN PATENT DOCUMENTS

JP 07-313034 A 12/1995
JP 10-127343 A 5/1998

(Continued)

OTHER PUBLICATIONS

English Language Abstract of JP 07-313034 A.

(Continued)

*Primary Examiner* — Justin Larson
*Assistant Examiner* — Lester L Vanterpool
(74) *Attorney, Agent, or Firm* — Rabin & Berdo, P.C.

(57) ABSTRACT

A sliding device, a baby seat using the sliding device, a back pack, a bag, and a belt back pack are provided, in which a carrier main body for accommodating a baby, a back pack main body for receiving goods, a carrier main body, and a carrier main body are provided in a slidably rotatable manner, and the baby can be taken down even without untying a shoulder string and the goods can be easily taken out. The sliding device includes a zipper connection member, a zipper portion in which zippers are successively engaged with each other in a length direction of the zipper connection member, and a slider engaged with the zipper portion to slidably move along the zipper portion.

10 Claims, 13 Drawing Sheets

(51) Int. Cl.

| | |
|---|---|
| ***A47D 13/02*** | (2006.01) |
| ***A45F 3/14*** | (2006.01) |
| ***A45F 4/02*** | (2006.01) |

(56) References Cited

U.S. PATENT DOCUMENTS

| | | | | |
|---|---|---|---|---|
| 5,522,528 | A * | 6/1996 | Petricola | 224/160 |
| D375,184 | S * | 11/1996 | Hickli et al. | D3/213 |
| 5,609,279 | A * | 3/1997 | O'Shea | 224/160 |
| 5,873,506 | A | 2/1999 | Golling et al. | |
| 6,026,547 | A * | 2/2000 | O'Donnell Kiely | 24/433 |
| 6,415,969 | B1 * | 7/2002 | Higuchi | 224/160 |
| 6,502,285 | B2 * | 1/2003 | Kiely | 24/433 |
| 6,866,174 | B2 * | 3/2005 | Hiscocks | 224/160 |
| 7,484,645 | B2 * | 2/2009 | Hoff et al. | 224/160 |
| 8,579,168 | B2 * | 11/2013 | Zack et al. | 224/160 |
| 2002/0129470 | A1 * | 9/2002 | Kiely | 24/433 |
| 2004/0065704 | A1 * | 4/2004 | Penny et al. | 224/161 |
| 2004/0164109 | A1 * | 8/2004 | Hiscocks | 224/160 |
| 2005/0045674 | A1 * | 3/2005 | Rehbein | 224/160 |
| 2009/0032558 | A1 * | 2/2009 | Klein, II | 224/161 |

FOREIGN PATENT DOCUMENTS

| | | | |
|---|---|---|---|
| KR | 20-0299438 | Y1 | 1/2003 |
| KR | 10-2006-0072902 | A | 6/2006 |
| KR | 20-2009-0007629 | U | 7/2009 |

OTHER PUBLICATIONS

English Language Abstract of JP 10-127343 A.
English Language Abstract of KR KR10-2006-0072902 A.
International Search Report of PCT/KR2010/008247 mailed on Aug. 2, 2011.

* cited by examiner

SLIDING DEVICE, BABY CARRIER, KNAPSACK, BAG, AND BELT BAG

TECHNICAL FIELD

The present invention relates to a sliding device and a carrier using the same. More particularly, the present invention relates to a sliding device, in which a main body of a carrier such as a baby seat for accommodating a baby, a back pack for receiving goods, a bag, or a belt back pack is provided in a slidably rotatable manner, thereby being capable of enabling a mom to take down the baby even without untying a shoulder strap or to easily take out the accommodated goods, and relates to the carrier using the sliding device.

BACKGROUND ART

In general, carriers are adapted to easily carry an object in a state of accommodating the object therein. There are various carriers such as a baby seat for accommodating a baby, a back pack for receiving goods, a bag, and a belt back pack.

Hereinafter, a baby seat, which is a typical carrier, will be reviewed. In general, a baby seat is used as a tool for holding a baby, and is formed to have a structure whereby a mom can carry a baby on her back or in her arms.

Typically, in the case where a mom intends to take down a baby for herself in a state where the mom carries the baby on her back, she should move the baby carried on her back round to the front before she takes down the baby.

However, it is difficult and complicated for the baby's mom to perform the above-described process without any help to cause inconvenience in use, and during the process of taking down the baby, the baby may be in danger of falling and hurting itself.

In order to solve the above-described problems, in Korean Utility Model Registration Application No. 20-2009-8606 entitled "Forward/backward changeable baby seat" filed on Jul. 28, 2009, a forward-backward changeable baby seat that can move forward or backward without untying the baby seat has been proposed.

In the above-described forward/backward changeable baby seat in the related art as described above, a construction, in which a baby sleeping vest is rotated along a rail groove of a belt, has been proposed. However, since the belt is configured to surround the waist of the mom and the baby seat is rotated around the waist of the wearer, the center of gravity of the baby is located on an upper portion thereof, and thus the baby may be in danger of falling down.

Further, since the belt should endure the weight of a baby, it is formed of a material such as PVC, and thus it not only imposes a burden on the waist but also becomes an obstacle to a natural motion in bending the body.

Further, the weight of the baby acts vertically on a bracket that is projected in a horizontal direction from a rail groove, and thus the bracket is weak in endurance.

Further, the belt structure in the related art as described above is formed of a hard material such as PVC, and when it is applied to a general back pack, it presses a specified body region.

Moreover, since the belt, which is a rotating means in the related art, has a structure in which a guide groove is formed and the bracket projected from the guide groove is utilized, its construction is complicated and cannot endure a heavy weight for a long time. Also, it is difficult to apply the belt to a baby seat, a back pack, or a bag.

DISCLOSURE

Technical Problem

Therefore, the present invention has been made in view of the above-mentioned problems, and a subject to be achieved by the present invention is to provide a sliding device which has a simple structure to endure a heavy weight and is formed of a soft material to facilitate its application to carriers such as a baby seat, a back pack, a bag, and the like.

Another subject to be achieved by the present invention is to provide a carrier as a baby seat which uses the above-described sliding device to enable a main body portion of the carrier to be slidably rotated in front and in the rear of the wearer, thereby being capable of facilitating the holding and taking down a baby, while permitting free movement even in a baby seat wearing state.

Further, still another subject to be achieved by the present invention is to provide a carrier as a back pack, a bag, or a belt back pack, which uses the above-described sliding device to enable a main body portion of the carrier to be slidably rotated in front and in the rear of the wearer, thereby enabling a portion of the back pack, bag or belt back pack in which goods are accommodated to be slidably rotated in forward and backward directions, to achieve convenience in use.

Technical Solution

In one aspect of the present invention, there is provided a sliding device, which includes a zipper connection member; a zipper portion in which zippers are successively engaged with each other in a length direction of the zipper connection member; and a slider engaged with the zipper portion to slidably move along the zipper portion.

The slider may include a slider main body engaged with the zipper portion to slidably move along the zipper portion, and a slider connection member engaged with a lower end portion of the slider main body.

One or two or more sliders may be formed.

The zipper connection member may be provided with an attachment hook having one end portion provided with a connector and the other end portion engaged with the connector.

The zipper connection member or the slider connection member may be formed of any one of soft materials including cloth, leather, and synthetic resin.

In another aspect of the present invention, there is provided a baby seat, which includes a carrier main body portion constructed to accommodate goods or a baby therein; a shoulder strap attachment portion coupled, at one surface thereof, to the carrier main body portion, and a shoulder strap attached to the other surface of the shawl plate; and a sliding device, according to a first embodiment of the present invention, making the carrier main body portion coupled to the shoulder strap attachment portion so that the carrier main body portion is slidably moved around the shoulder strap attachment portion.

The carrier main body portion may include a carrier main body and a carrier attachment plate coupled, at one surface thereof, to the carrier main body.

A slider of the sliding device may be attached to the carrier main body portion, and a zipper connection member of the sliding device may be attached to the shoulder strap attachment portion.

The zipper connection member may have a structure in which one side of the zipper connection member is attached to one surface of the shoulder strap attachment portion and the other side extends to the other surface of the shoulder strap attachment portion through a side direction of the shoulder strap attachment portion.

The carrier main body portion and the shoulder strap attachment portion may be attached through an upper attachment hook portion and a lower attachment portion, the upper attachment hook portion may include a connector provided on an upper portion of the carrier main body portion and an attachment hook provided on an upper portion of the shoulder strap attachment portion and coupled to the connector, and the lower attachment hook portion may include a connector provided on a lower portion of the carrier main body portion and an attachment hook provided on a lower portion of the shoulder strap attachment portion and coupled to the connector.

A fixing member for hook-fixing both end portions of the zipper connection member may be formed on the shoulder strap, and include a locking hook formed on one side of the shoulder strap and hooked on an end portion of the zipper connection member to fix the end portion of the zipper connection member and a fixture formed on the other side of the shoulder strap to fix the end portion of the zipper connection member in a state where the end portion of the zipper connection member is penetratingly inserted into the fixture.

In another aspect of the present invention, there is provided a carrier, which includes a carrier main body portion formed with a space to accommodate goods therein; a shoulder strap attachment portion coupled to the carrier main body portion; and a sliding device, according to a first embodiment of the present invention, making the carrier main body portion coupled to the shoulder strap attachment portion so that the carrier main body portion is slidably moved around the shoulder strap attachment portion.

The carrier main body portion may include a carrier main body and a carrier attachment plate coupled to the carrier main body, and the shoulder strap attachment portion may include a shawl plate and a shoulder strap coupled to the shawl plate.

A slider of the sliding device may be attached to the carrier main body portion, a zipper connection member of the sliding device may be attached to the shoulder strap attachment portion, and the zipper connection member may have a structure in which one side of the zipper connection member is attached to one surface of the shoulder strap attachment portion and the other side extends to the other surface of the shoulder strap attachment portion through a side direction of the shoulder strap attachment portion.

The carrier main body portion and the shoulder strap attachment portion may be attached through an upper attachment hook portion and a lower attachment portion, the upper attachment hook portion may include a connector provided on an upper portion of the carrier main body portion and an attachment hook provided on an upper portion of the shoulder strap attachment portion and coupled to the connector, and the lower attachment hook portion may include a connector provided on a lower portion of the carrier main body portion and an attachment hook provided on a lower portion of the shoulder strap attachment portion and coupled to the connector.

A fixing member for hook-fixing both end portions of the zipper connection member may be formed on the shoulder strap, and include a locking hook formed on one side of the shoulder strap and hooked on an end portion of the zipper connection member to fix the end portion of the zipper connection member and a fixture formed on the other side of the shoulder strap to fix the end portion of the zipper connection member in a state where the end portion of the zipper connection member is penetratingly inserted into the fixture.

In another aspect of the present invention, there is provided a carrier, which includes a carrier main body portion formed with a space to accommodate goods therein; a shoulder strap attachment portion coupled to the carrier main body portion; and a sliding device, according to a first embodiment of the present invention, making the carrier main body portion coupled to the shoulder strap attachment portion so that the carrier main body portion is slidably moved around the shoulder strap attachment portion.

The carrier main body portion may include a carrier main body and a carrier attachment plate coupled to the carrier main body, and the shoulder strap attachment portion may include a shawl plate and a shoulder strap coupled to the shawl plate.

A slider of the sliding device may be attached to the carrier main body portion, a zipper connection member of the sliding device may be attached to the shoulder strap attachment portion, and the zipper connection member may have a structure in which one side of the zipper connection member is attached to one surface of the shoulder strap attachment portion and the other side extends to the other surface of the shoulder strap attachment portion through a side direction of the shoulder strap attachment portion.

The carrier main body portion and the shoulder strap attachment portion may be attached through an upper attachment hook portion and a lower attachment portion, the upper attachment hook portion may include a connector provided on an upper portion of the carrier main body portion and an attachment hook provided on an upper portion of the shoulder strap attachment portion and coupled to the connector, and the lower attachment hook portion may include a connector provided on a lower portion of the carrier main body portion and an attachment hook provided on a lower portion of the shoulder strap attachment portion and coupled to the connector.

A fixing member for hook-fixing both end portions of the zipper connection member may be formed on the shoulder strap, and include a locking hook formed on one side of the shoulder strap and hooked on an end portion of the zipper connection member to fix the end portion of the zipper connection member and a fixture formed on the other side of the shoulder strap to fix the end portion of the zipper connection member in a state where the end portion of the zipper connection member is penetratingly inserted into the fixture.

In still another aspect of the present invention, there is provided a carrier, which includes a carrier main body portion formed with a space to accommodate goods therein; and a sliding device, according to a first embodiment of the present invention, coupled to the carrier main body portion, wherein the carrier main body portion is slidably rotated along a zipper portion formed on a zipper connection member of the sliding device.

A slider of the sliding device may be attached to the carrier main body portion.

A connector may be provided on an upper portion of the carrier main body portion, and a plurality of upper attachment hooks coupled to the connector may be provided on an upper side portion of the zipper connection member.

Advantageous Effects

According to the present invention, a sliding device, which includes a zipper connection member, a zipper portion attached to the zipper connection member, and a slider engaged with the zipper portion, has a simple structure to endure a heavy weight and is formed of a soft material to facilitate its application to a baby seat, a back pack, a bag, and the like.

By applying the sliding device according to the present invention to a baby seat, the baby seat enables a carrier main body portion in which a baby is accommodated to be slidably rotated in front and in the rear of the baby seat wearer, and facilitates the holding and taking down the baby to increase the baby's safety.

Further, the sliding device provided on the baby seat is installed at a height that is higher than an intermediate portion of the baby seat rather than the waist portion of the wearer, and thus the structural stability and the increase of endurance can be sought.

By applying the sliding device according to the present invention to a back pack, a bag, and a belt back pack, the main body portion in which goods are accommodated can be moved in front and in the rear of the wearer to facilitate the accommodation of the goods.

BRIEF DESCRIPTION OF THE DRAWINGS

The foregoing and other objects, features and advantages of the present invention will become more apparent from the following detailed description when taken in conjunction with the accompanying drawings in which.

BEST MODE

Hereinafter, preferred embodiments of the present invention will be described in detail with reference to the accompanying drawings.

[First Embodiment]

A sliding device 100 according to a first embodiment of the present invention can endure a heavy weight, is formed of a soft material, and enables a carrier such as a baby seat, a back pack, or a bag to be described later to be slidably rotated in front and in the rear of a wearer.

Figure 1:
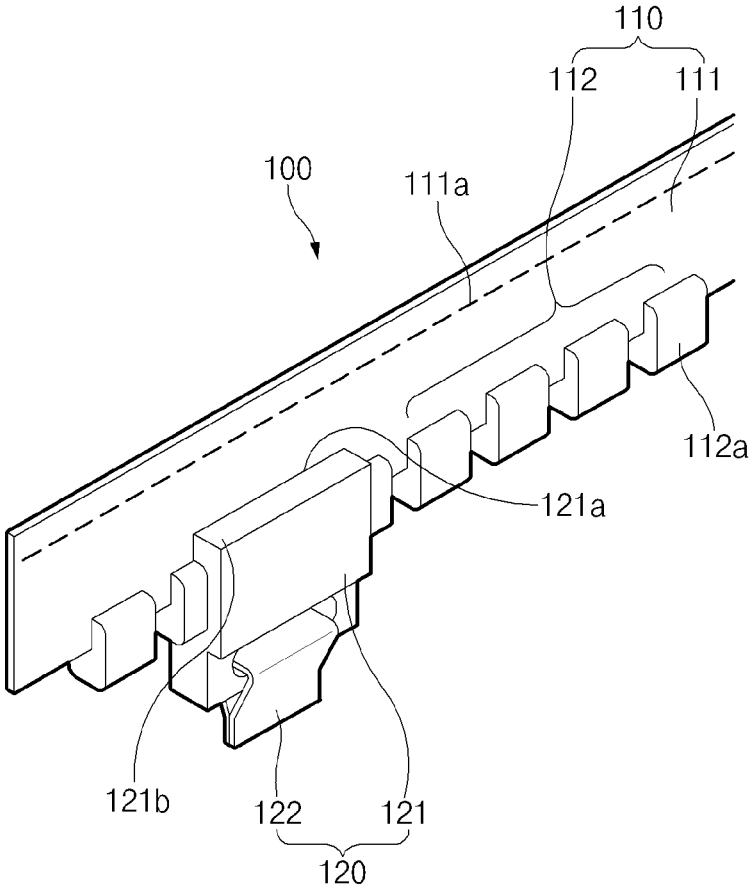
FIG. 1 is a perspective view illustrating the assembled state of a sliding device according to a first embodiment of the present invention.
Figure 2:
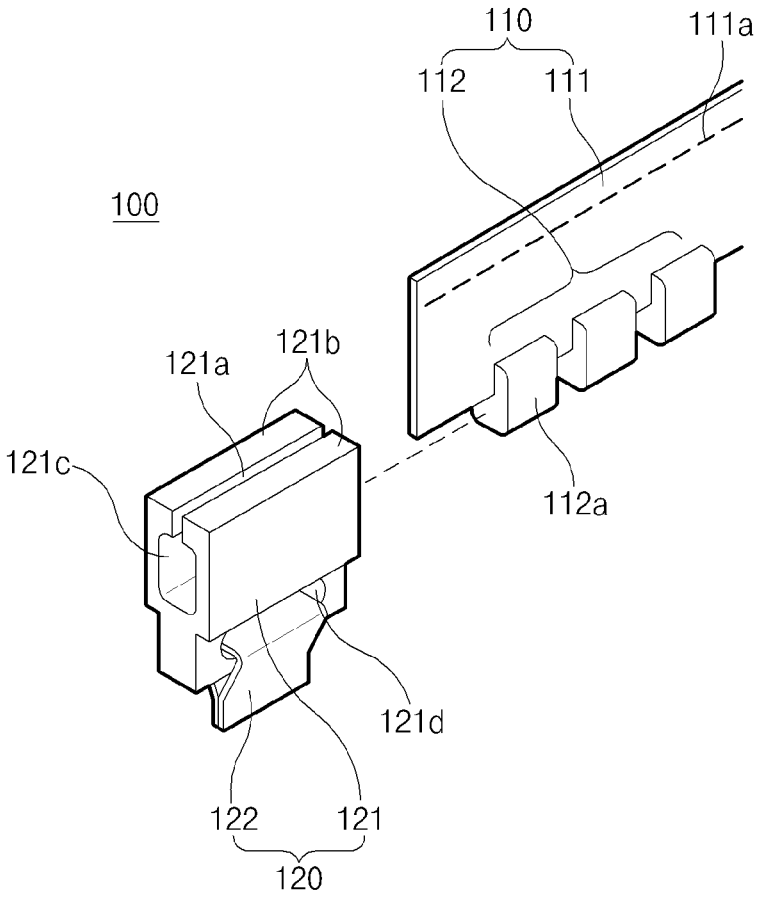
FIG. 2 is an exploded perspective view of the sliding device according to the first embodiment of the present invention.

The sliding device 100 according to the first embodiment of the present invention, as illustrated in FIGS. 1 and 2, includes a zipper engagement portion 100, and a slider 120 engaged with the zipper engagement portion 110.

The zipper engagement portion 110 includes a zipper connection member 111 formed in the form of a ling band, and a zipper portion 112 which is provided on a lower end portion of the zipper connection member 111 and in which zippers are successively engaged with each other in a length direction. A slider 120 is engaged with the zipper portion 112 to slidably move along the zipper portion 112.

The zipper connection member 111 is preferably formed of a soft material, for example, any one of cloth, leather, and synthetic resin, so as to be easily attached to a certain position of a product to which the sliding device 100 is applied, and more preferably, is formed of cloth.

The upper side portion of the zipper connection member 111 is a region that is directly attached to a product on which the sliding device 100 is mounted, and the upper side portion of the zipper connection member 111 is attached thereto by sewing or the like. That is, as illustrated in FIGS. 1 and 2, a dotted line 111*a* formed on the upper side portion of the zipper connection member 111 indicates a region attached by sewing.

Here, as the zipper portion 112, a zipper that is typically used to open/close a suit or a picket may be used as it is, or as illustrated in FIGS. 1 and 2, tetragonal box type zippers 112*a*, from which unnecessary portions are removed, are manufactured to be used. It is preferable that the zippers are manufactured in the form of tetragonal boxes so as to endure a heavy weight.

The slider 120 includes a slider main body 121 engaged with the zipper portion 112 to slidably move along the zipper portion 112, and a slider connection member 122 engaged with a lower end portion of the slider main body 121.

The slider main body 121 has a side cross-section approximately in a "□"-shape and an upper center region 121*a* that is cut and open, and an end portion 121*b* of the upper side portion is attached to the upper side surface of the zipper 112*a*. Accordingly, the zippers 112*a* are inserted into an inner space portion 121*c* of the slider main body 121.

The slider connection member 122 is a region that is directly fastened to the product to which the sliding device 100 is applied. The slider connection member 122 is engaged with an engagement hole 121*d* formed on a lower end portion of the slider main body 121, and is formed of a soft material, for example, any one of cloth, leather, and soft synthetic resin, to facilitate the attachment by sewing or the like, and preferably, is formed of cloth.

On the other hand, one or two or more sliders 120 may be formed, and preferably, two sliders 120 are provided. This is to disperse the force acting on the zipper portion 112 and to increase the stability when a product, to which a heavy weight is applied, is connected to the slider connection member 122.

In the case where a plurality of sliders 120 is formed, the sliders 120 may be connected to each other by a connection component (not illustrated).

According to the sliding device 100 as constructed above, the slider 120, which is engaged with the zipper portion 112, is slidably moved along the zipper portion 112 to stably move a heavy-weight product that is fastened to the slider. Further, the zipper connection member 11 is formed of cloth that is a soft material to increase close adhesion to the wearer.

Figure 3:
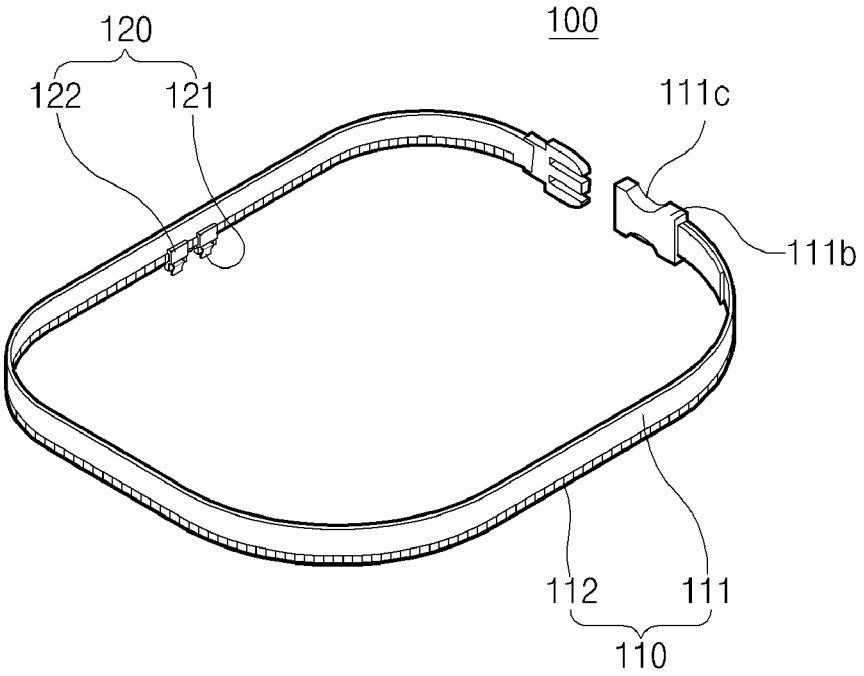
FIG. 3 is a view illustrating the use state of the sliding device according to the first embodiment of the present invention.

On the other hand, the zipper connection member 111 of the sliding device 100, as illustrated in FIG. 3, is connected in the form of a ring.

That is, a connector 111*b* is provided on one end portion of the zipper connection member 111, and an attachment hook 111*c* that is coupled to the connector 111*b* is provided on the other end portion.

Accordingly, through the coupling of the connector 111*b* to the attachment hook 111*c*, the zipper connection member 111 is connected in the form of a ring, and therefore the slider 120 is slidably rotated along the zipper portion 112.

Here, the end portions of the zipper connection member 111 are coupled to each other with its length adjustable by the connector 111*b* and the attachment hook 111*c*, and the length of the zipper connection member 111 can be adjusted to fit the body structure of the wearer.

Hereinafter, in explaining other embodiments of the present invention using the first embodiment of the present invention, the same constituent reference numerals are used for the constructions having the same construction and functions as the first embodiment of the present invention, and duplicate explanation thereof will be omitted.

[Second Embodiment]

The second embodiment of the present invention, as illustrated in FIGS. 4 to 13, relates to carriers 10, 20, 30, and in which the sliding device 100 according to the first embodiment of the present invention is used. In the second embodiment, a first example is a baby seat, a second example is a back pack, a third example is a bag, and a fourth example is a belt back pack.

That is, the baby seat type carrier 10 according to the first example of the second embodiment of the present invention is such constructed that a baby seat main body portion 200 is slidably moved around a shoulder strap attachment portion 300 by using the sliding device 100 according to the first embodiment of the present invention.

Figure 4:
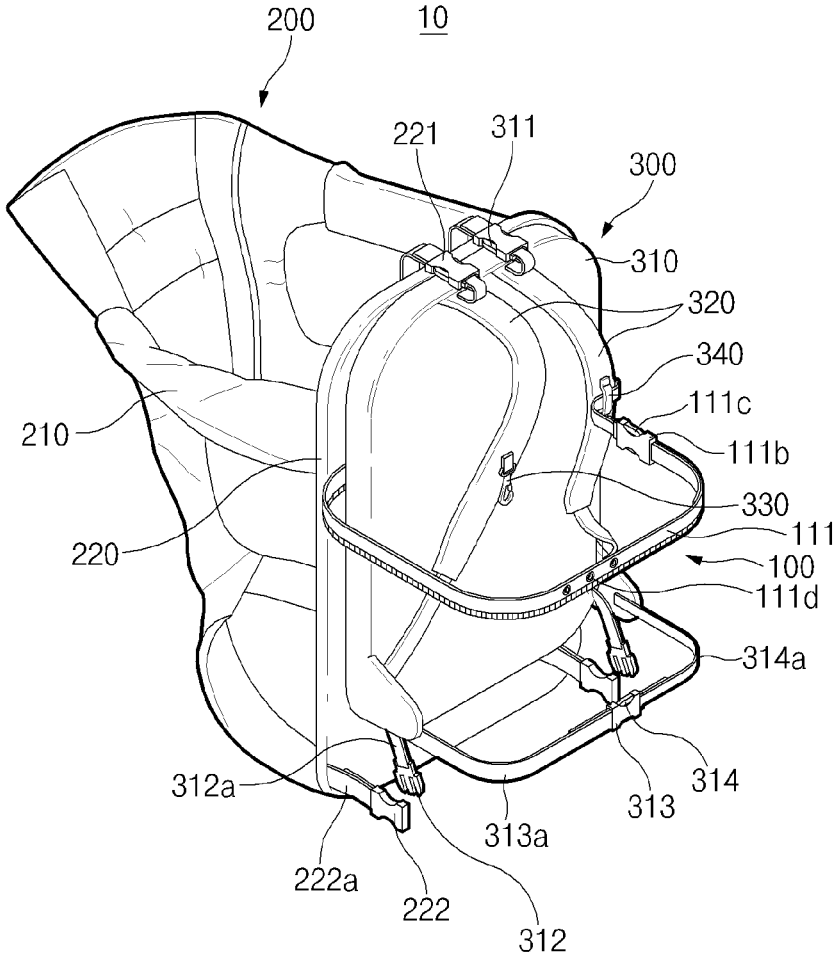
FIG. 4 is a perspective view illustrating the assembled state of a baby seat type carrier according to a first example of a second embodiment of the present invention.
Figure 5:
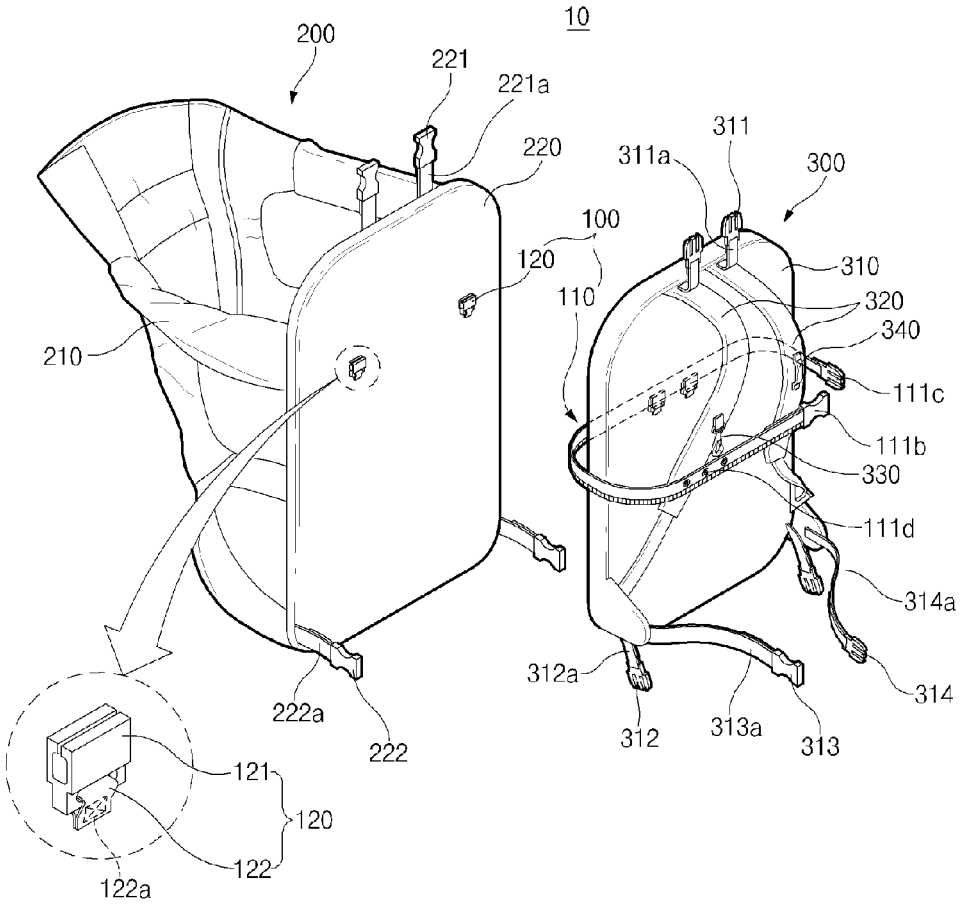
FIG. 5 is an exploded perspective view of the baby seat type carrier according to the first example of the second embodiment of the present invention.
Figure 6:
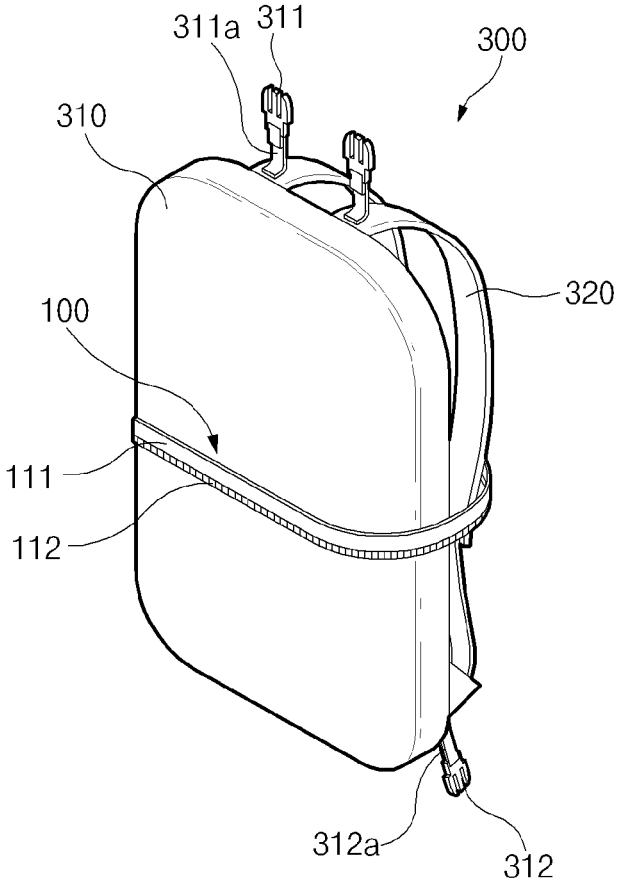
FIG. 6 is a perspective view illustrating a shoulder strap attachment portion of the baby seat type carrier according to the first example of the second embodiment of the present invention.

The baby seat type carrier 10 according to the first example of the second embodiment of the present invention, as illustrated in FIGS. 4 to 6, includes a carrier main body portion 200 in which a baby is accommodated; a shoulder strap attachment portion 300 coupled to the carrier main body portion 200, which the wearer wears on the shoulder; and a sliding device 100 making the carrier main body portion 200 coupled to the shoulder strap attachment portion 300 to make the carrier main body portion 200 slidably rotated around the shoulder strap attachment portion 300.

The carrier main body portion 200 includes a carrier main body 210 and a carrier attachment plate 220 attached to the front of the carrier main body 210 (front as seen in FIG. 4).

Here, the carrier main body 210 and the carrier attachment plate 220 are integrally attached to each other by sewing or the like.

The shoulder strap attachment portion 300 includes a shawl plate 310 coupled to the carrier attachment plate 220 that is approximately in a plate shape having a predetermined thickness, and a shoulder strap 320 attached to front both sides (front as seen in FIG. 4) of the shawl plate 310.

Here, the shawl plate 310 is in direct contact with the back of the wearer, and is provided with a cushion function so that the wear feels smooth during wearing.

Further, since the zipper connection member 111 of the sliding device 100 is attached to the rear of the shawl plate 310 (rear as seen in FIG. 4), the shawl plate 310 has a predetermined rigidity so as to sufficiently endure the weight.

On the other hand, the carrier main body portion 200 and the shoulder strap attachment portion 300 are coupled to each other by an upper attachment hook portion and a lower attachment hook portion (see FIG. 5).

The upper attachment hook portion is to make the carrier main body portion 200 coupled to an upper portion of the shoulder strap attachment portion 300, and includes a connector 221 attached to the upper portion of the carrier attachment plate 220 by a connection band 221*a*, and an attachment hook 311 attached to the upper portion of the shawl plate 310 by a connection band 311*a* and coupled to the connector 221.

The lower attachment hook portion is to make the carrier main body portion 200 coupled to a lower portion of the shoulder strap attachment portion 300, and includes a connector 222 attached to both lower end portions of the carrier attachment plate 220 by connection bands 222*a*, respectively, and an attachment hook 312 attached to both lower end portions of the shawl plate 310 by connection bands 312*a*, respectively, and coupled to the connector 222.

Here, the connection bands 221*a*, 222*a*, 311*a*, and 3112*a* are formed of cloth or synthetic resin having elasticity, and the connectors 221 and 222 and the attachment hooks 311 and 312 are coupled to each other with the length adjustable.

The upper and lower attachment hook portions make the connector 221 and the attachment hook 311, which constitute the upper attachment hook portion, coupled to each other and make the connector 222 and the attachment hook 312, which constitute the lower attachment hook portion, coupled to each other in a state where the carrier main body portion 200 and the shoulder strap attachment portion 300 are closely coupled to each other, and therefore the carrier main body portion 200 and the shoulder strap attachment portion 300 can be stably attached to each other.

On the other hand, a waist connection hook portion is provided on the lower portion of the shawl plate 310 to surround the waist of the carrier (baby seat) wearer, and includes a connector 313 that is attached to one side of a lower portion of the shawl plate 310 by a connection band 313*a*, and a connection hook 314 attached to the other side of the lower portion of the shawl plate 310 and coupled to the connector 313.

Here, the connection bands 313*a* and 314*a* are formed of cloth or synthetic resin having elasticity, and the connector 313 and the attachment hook 314 are coupled to each other with the length adjustable.

According to the waist connection hook portion, if the connector 313 and the connection hook 314 are coupled in front of the wearer, the carrier main body portion 200 is prevented from moving rearward (the rear as seen in FIG. 4).

The sliding device 100 is to make the carrier main body portion 200 coupled to the shoulder strap attachment portion 300 so that the carrier main body portion 200 is slidably rotated around the shoulder strap attachment portion 300, and includes a zipper engagement portion 110 attached to the shawl plate 310 of the shoulder strap attachment portion 300, and a slider having one side that is attached to the carrier main body 210 of the carrier main body portion 200 and the other side that is coupled to the lower end portion of the zipper engagement portion 110.

On the other hand, the sliding device 100 has the same construction and function as the sliding device 100 according to the first embodiment of the present invention, and the same constituent reference numerals are used. The detailed explanation thereof will be omitted.

That is, the zipper connection member 111 of the zipper engagement portion 110 has one side that is attached to one surface of the shawl plate 310 (the rear as seen in FIG. 6) by sewing or the like and the other side that extends to the other surface of the shoulder strap attachment portion 300 (front as seen in FIG. 6) through a side direction of the shoulder strap attachment portion 300.

In this case, it is preferable that the position where the zipper connection member 111 is attached to the shawl plate 310 has a height that is higher than an intermediate portion of the baby seat. This is to prevent the center of gravity of the carrier main body portion 200 from tending to the lower portion when the carrier main body portion 200 is made to slide in a state where a baby is carried on the back. Through this, an unstable operation, such as leaning back and falling down of a baby, is prevented in a state where the carrier main body 210 is slidably rotated.

Further, the zipper connection member 111 is connected in the form of a ring through the connector 111*b* provided on one end portion and the attachment hook 111*c* coupled to the connector 111*b*.

On the other hand, the slider 120 includes a slider main body 121 engaged with the zipper portion 112 of the zipper engagement portion 110, and a slider connection member 122 coupled to the slider main body 121, and the slider connection member 122 is attached to the rear of the carrier attachment plate 220 as indicated by a dotted line 122*a* in FIG. 5 by sewing.

That is, if the slider 120 of the sliding device 100 slides along the zipper portion 112, the carrier main body portion 200 is slidably moved in interlocking with the slider 120, and thus the carrier main body portion 200 can be slidably rotated around the shoulder strap attachment portion 300.

On the other hand, both end portions of the zipper connection member 111 are hook-fixed to the fixing member that is formed on the shoulder strap 320.

That is, the fixing member includes a locking hook 330 formed on one side of the shoulder strap 320 and locked in the engagement hole 111*d* formed on the end portion of the zipper connection member 11 to fix the end portion of the zipper connection portion 111, and a fixture 340 formed on the other side of the shoulder strap 320 to fix the end portion of the zipper connection member 111 in a state where the end portion of the zipper connection member 111 is penetratingly inserted into the fixture 340.

That is, by fixing the both end portions of the zipper connection member 111 to each other through the locking hook 330 and the fixture 340, the weight of the carrier main body portion 200, which has slidably moved to the front of the wearer along the zipper portion 112, can be stably supported.

On the other hand, in the sliding device 100, the weight that can be applied through the slider connection member 122 of the slider 120 may be up to 1 ton.

Hereinafter, the wearing and use state of the baby seat type carrier according to the first example of the second embodiment of the present invention will be described.

Figure 7:
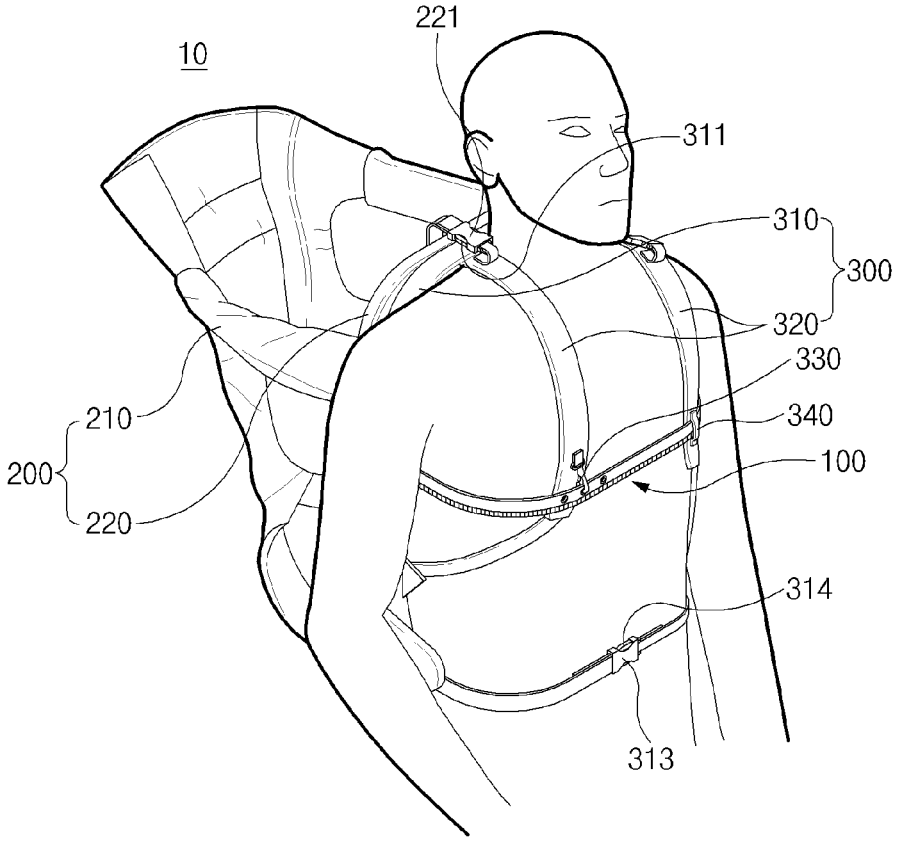
FIG. 7 is a perspective view illustrating the wearing state of the baby seat type carrier according to the first example of the second embodiment of the present invention.
Figure 8:
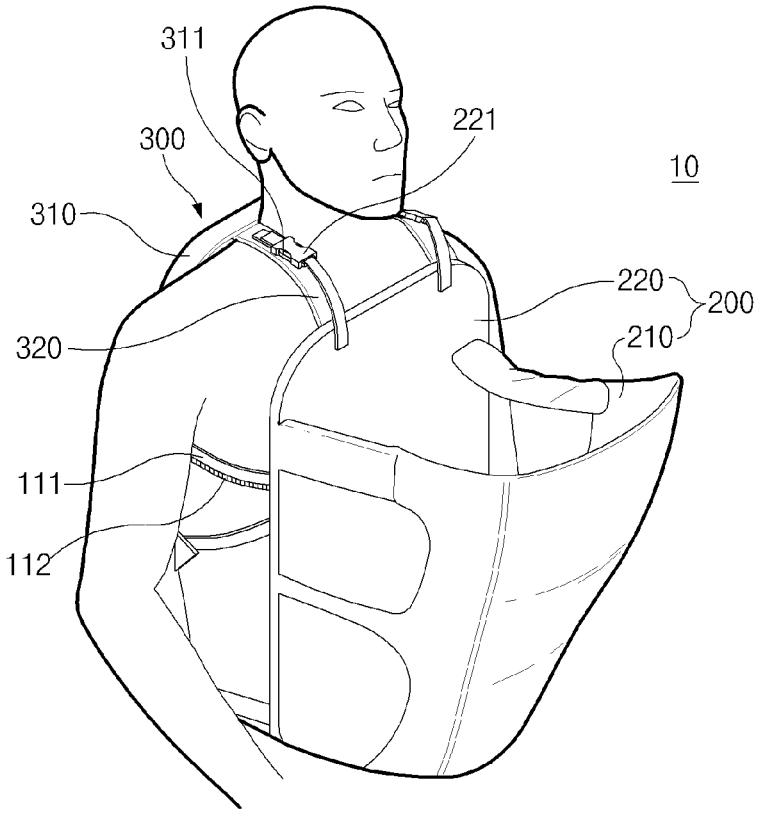
FIG. 8 is a perspective view illustrating the rotating state of the baby seat type carrier according to the first example of the second embodiment of the present invention.

FIG. 7 illustrates a state where a wearer carries a baby accommodated in the baby seat type carrier on a wearer's back, and FIG. 8 illustrates a state where a wearer moves the baby seat type carrier to the front of the wearer by rotating the carrier main body portion in a state of FIG. 7.

First, in a state where a wearer carries the baby seat type carrier 10 in which a baby is accommodated on the wearer's back, the wearer releases the coupling state of the upper and lower attachment hook portions which are coupled to the upper and lower portions of the carrier attachment plate 220 and the shawl plate 310. That is, the wearer releases the coupling state of the connector 221 and the attachment hook 311 which constitute the upper attachment hook portion and releases the coupling state of the connector 222 and the attachment hook 312 which constitute the lower attachment hook portion.

If the coupling of the upper and lower attachment hook portion is released as described above, the carrier attachment plate 220 and the shawl plate 310 are in a movable state.

Next, if the wearer pulls the carrier attachment plate 220 in a side direction in a state where the wearer raises the wearer's arm, the slider 120 attached to the carrier attachment plate 220 moves along the zipper portion 112 coupled to the zipper connection member 111, and thus the carrier attachment plate 220 and the carrier main body 210 are slidably rotated to the front of the wearer. That is, the state is changed from the state illustrated in FIG. 7 to the state illustrated in FIG. 8.

Thereafter, the connector 221 and the attachment hook 311 which constitute the upper attachment hook portion and the connector 222 and the attachment hook 312 which constitute the lower attachment hook portion are coupled, respectively, to make the carrier main body portion 200 and the shoulder strap attachment portion 300 coupled to each other.

In the above-described method, the carrier main body portion 200 can be slidably moved to the front of the wearer, and thus the convenience in use can be increased.

Figure 9:
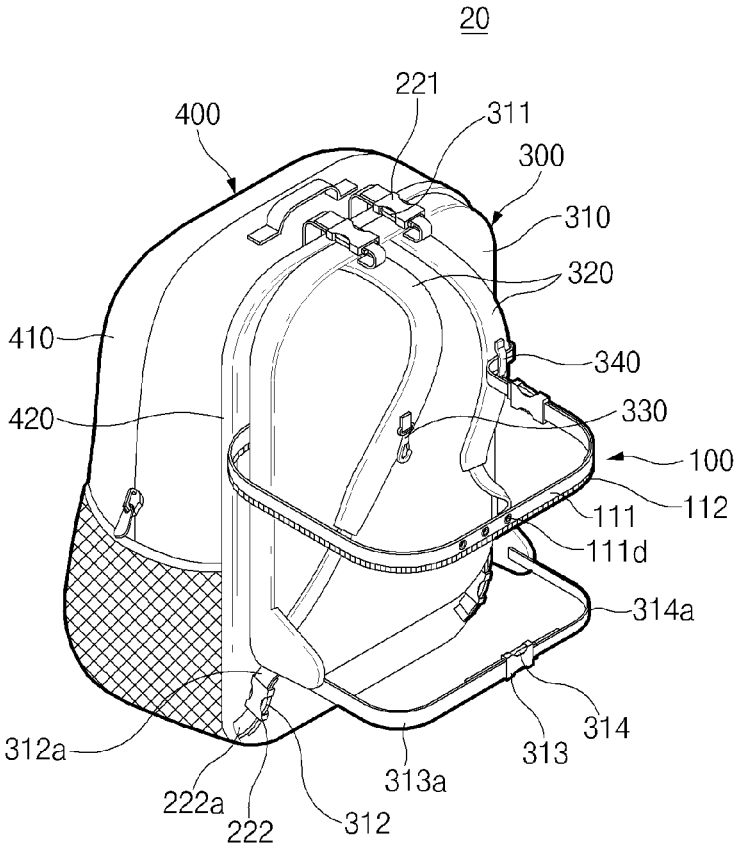
FIG. 9 is a perspective view illustrating the assembled state of a back pack type carrier according to a second example of the second embodiment of the present invention.
Figure 10:
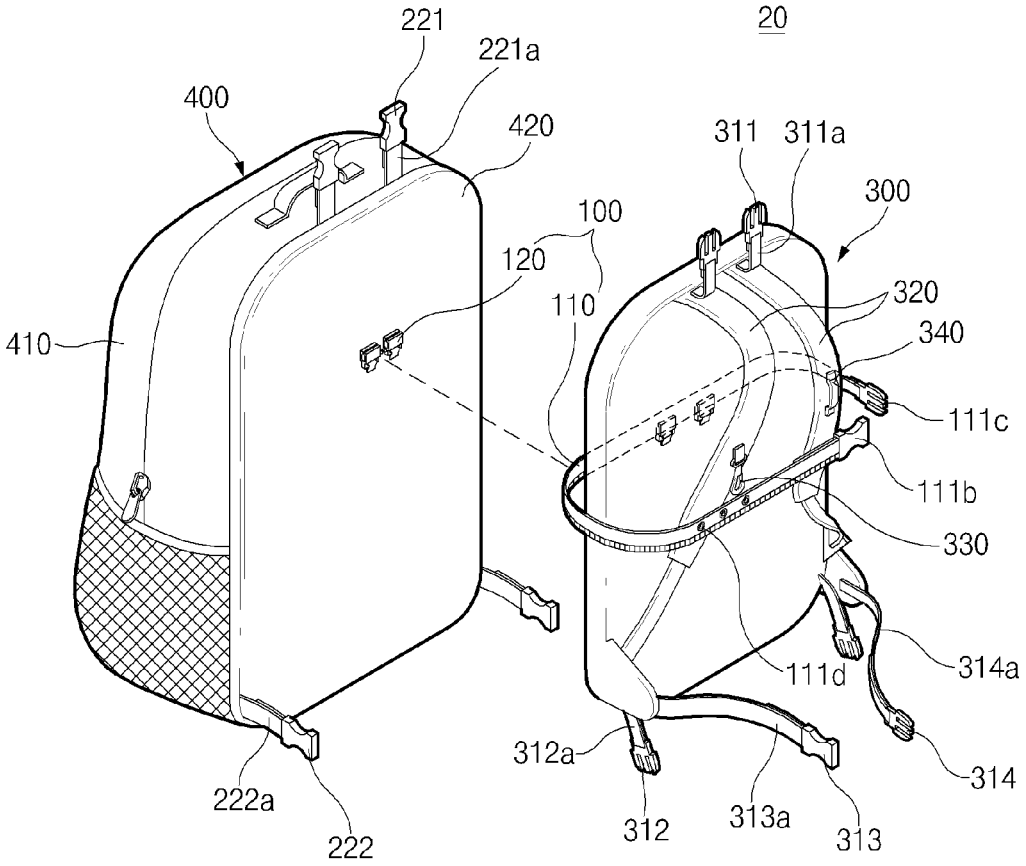
FIG. 10 is an exploded perspective view of the back pack type carrier according to the second example of the second embodiment of the present invention.

The second example of the second embodiment of the present invention, as illustrated in FIGS. 9 and 10, relates to a back pack type carrier 20 in which the sliding device 100 according to the first and second embodiments of the present invention is used.

That is, the back pack type carrier 20 according to the second example of the second embodiment of the present invention is such constructed that a carrier main body portion 400 is slidably moved around a shoulder strap attachment portion 300 by using the sliding device 100 according to the first and second embodiments of the present invention.

The back pack type carrier 20 according to the second example of the second embodiment of the present invention, as illustrated in FIGS. 9 and 10, includes a carrier main body portion 400 in which goods are accommodated; a shoulder strap attachment portion 300 coupled to the carrier main body portion 400; and a sliding device 100 making the carrier main body portion 400 coupled to the shoulder strap attachment unit 300 so as to make the carrier main body portion 400 slidably rotated around the shoulder strap attachment portion 300.

Hereinafter, the construction of the back pack 30 according to the third embodiment of the present invention will be described in more detail.

The carrier main body portion 400 includes a carrier main body 410 having an accommodation space formed thereon to accommodate the goods, and a carrier attachment plate 420 provided in front of the carrier main body 410 (front as seen in FIG. 9). The carrier main body 410 and the carrier attachment plate 420 are integrally attached to each other by sewing or the like.

The shoulder strap attachment portion 300 includes a shawl plate 310 coupled to the carrier main body portion 400 in the rear thereof (rear as seen in FIG. 9) and a shoulder strap 320 provided in the rear of the shawl plate 310.

Here, since the shoulder strap attachment portion 300 has the same construction and function as the shoulder strap attachment portion 300 according to the first example of the second embodiment of the present invention, the same constituent reference numerals are used, and the duplicate explanation thereof will be omitted.

On the other hand, the upper and lower portions of the carrier attachment plate 420 and the shawl plate 310 are separably coupled to each other through the upper and lower attachment hook portion.

Here, since the upper and lower attachment hook portions have the same construction and function as the upper and lower attachment hook portion according to the first example of the second embodiment of the present invention, the same constituent reference numerals are used, and the duplicate explanation thereof will be omitted.

Since the sliding device 100 has the same construction and function as the sliding devices 100 according to the first embodiment of the present invention and the first example of the second embodiment of the present invention, the same constituent reference numerals are used, and the duplicate explanation thereof will be omitted.

On the other hand, since the back pack type carrier 20 according to the second example of the second embodiment of the present invention adopts the carrier main body portion 400 that accommodates the goods instead of the carrier main body portion 200 that accommodates a baby, there is only a difference between the carrier main body portion 200 according to the first example of the second embodiment of the present invention and the carrier main body portion 400 according to the second example of the second embodiment of the present invention, but all of other constructions have the same construction.

Hereinafter, the wearing and use state of the back pack type carrier according to the second example of the second embodiment of the present invention will be described.

In order to move the carrier main body portion 400 that is located on the wearer's back to the chest side of the wearer in the back pack type carrier 20 according to the second example of the second embodiment of the present invention, the wearer releases the coupling state of the upper and lower attachment hook portions which are coupled to the upper and lower portions of the carrier attachment plate 420 and the shawl plate 310, respectively.

Next, if the wearer pulls the carrier attachment plate 420 in a side direction in a state where the wearer raises the wearer's arm, the slider 120 attached to the carrier attachment plate 420 moves along the zipper portion 112 coupled to the zipper connection member 111, and thus the carrier attachment plate 420 and the carrier main body 410 are slidably rotated to the front of the wearer.

Accordingly, by slidably moving the carrier main body portion 400 in forward/backward directions of the wearer by using the sliding device 100, the carrier main body portion 400 can be slidably moved to the front of the wearer to increase the convenience in use.

Figure 11:
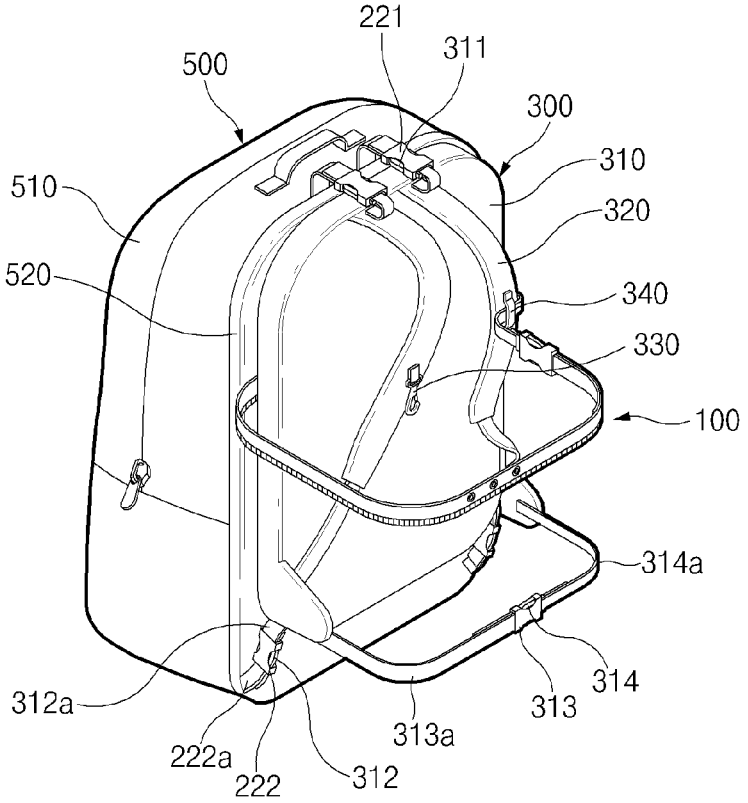
FIG. 11 is a perspective view illustrating the assembled state of a bag type carrier according to a third example of the second embodiment of the present invention.
Figure 12:
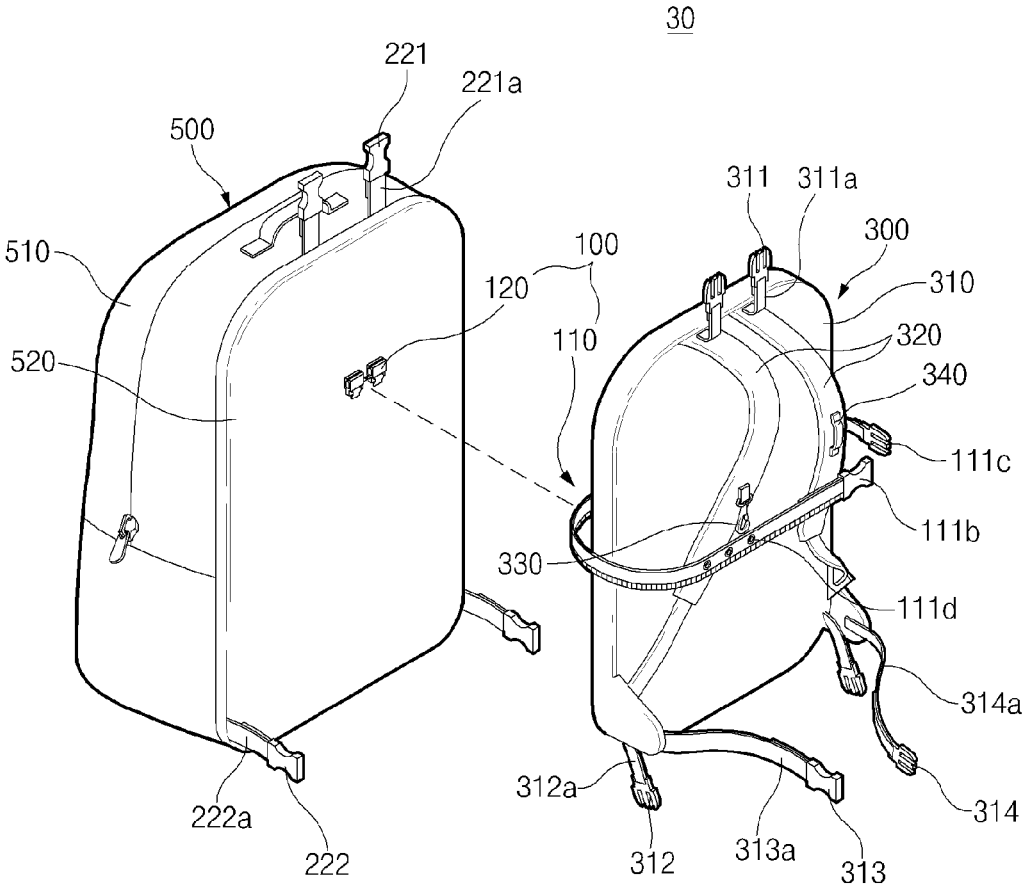
FIG. 12 is an exploded perspective view of the bag type carrier according to the third example of the second embodiment of the present invention.

The third example of the second embodiment of the present invention, as illustrated in FIGS. 11 and 12, relates to a bag type carrier 30 in which the sliding device 100 according to the first embodiment of the present invention is used.

That is, the bag type carrier 30 according to the third example of the second embodiment of the present invention is such constructed that a carrier main body portion 500 is slidably rotated around a shoulder strap attachment portion 300 by using the sliding device 100 according to the first embodiment of the present invention.

The bag type carrier 30 according to the third example of the second embodiment of the present invention includes a carrier main body portion 500 in which goods are accommodated; a shoulder strap attachment portion 300 coupled to the carrier main body portion 500; and a sliding device 100 making the carrier main body portion 500 coupled to the shoulder strap attachment unit 300 so as to make the carrier main body portion 500 slidably rotated around the shoulder strap attachment portion 300.

The carrier main body portion 500 includes a carrier main body 510 accommodating the goods, and a carrier attachment plate 520 provided in the rear of the carrier main body 510.

Here, since the carrier main body portion 500 is different from the carrier main body portion 400 according to the second example of the second embodiment of the present invention in size and application field, but their constructions and functions are the same.

That is, the carrier main body portion 400 according to the second example of the second embodiment of the present invention and the carrier main body portion 500 according to the third example of the second embodiment of the present invention have the same construction and functions. However, the carrier main body portion 400 according to the second example of the second embodiment of the present invention is manufactured in large size since it is used for mountain climbing that requires an accommodation space for easily accommodating mountain-climbing products, while the carrier main body portion 500 according to the third example of the second embodiment of the present invention is provided with an accommodation space for easily accommodating small products, such as a book or the like.

Since the shoulder strap attachment portion 300 has the same construction and function as the shoulder strap attachment portion 300 according to the first example of the second embodiment of the present invention, the same constituent reference numerals are used, and the duplicate explanation thereof will be omitted.

Since the sliding device 100 has the same construction and function as the sliding devices 100 according to the first embodiment of the present invention and the first example of the second embodiment of the present invention, the same constituent reference numerals are used, and the duplicate explanation thereof will be omitted.

On the other hand, the bag type carrier 30 according to the third example of the second embodiment of the present invention adopts the carrier main body portion 500 instead of the carrier main body portion 400 according to the second example of the second embodiment of the present invention. Since the carrier main body portion 500 according to the third example of the second embodiment of the present invention is different from the carrier main body portion 400 according to the second example of the second embodiment of the present invention in size and use purpose, but their constructions and functions are the same.

Accordingly, the wearing and use method of the bag type carrier 30 according to the third example of the second embodiment of the present invention are the same as the back pack type carrier 20 according to the second example of the second embodiment of the invention.

Figure 13:
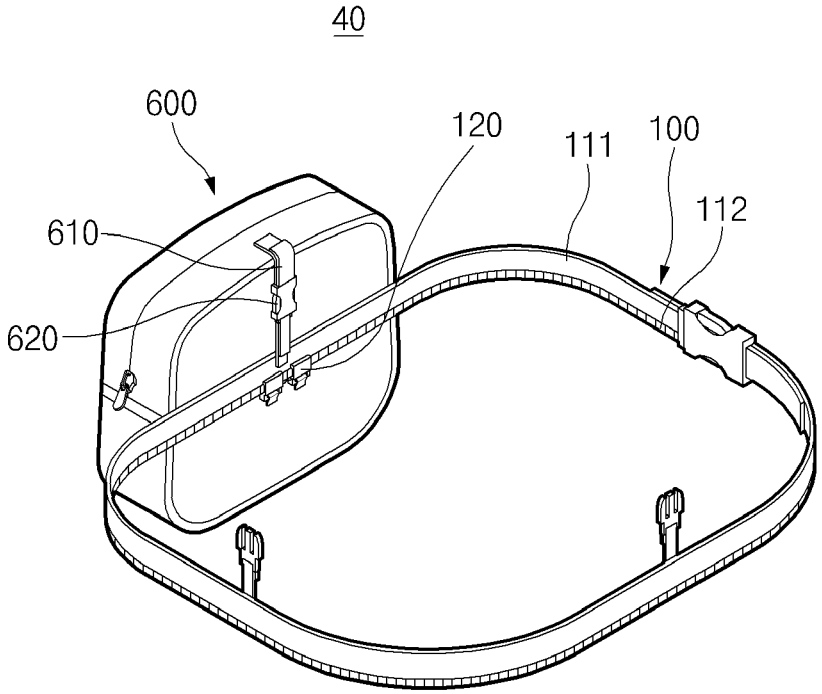
FIG. 13 is a perspective view illustrating the assembled state of a belt back pack type carrier according to a fourth example of the second embodiment of the present invention.

The fourth example of the second embodiment of the present invention, as illustrated in FIG. 13, relates to a belt back pack type carrier 40 in which the sliding device 100 according to the first embodiment of the present invention is used.

That is, the belt back pack type carrier 40 according to the fourth example of the second embodiment of the present invention is such constructed that a carrier pack main body portion 600 is slidably rotated around a shoulder strap attachment portion 300 by using the sliding device 100 according to the first embodiment of the present invention.

The belt back pack type carrier 40 according to the fourth example of the second embodiment of the present invention includes a carrier pack main body portion 600 in which goods are accommodated; and a sliding device 100 coupled to the carrier pack main body portion 600, wherein the carrier pack main body portion 600 is slidably rotated according to the sliding device 100.

The sliding device 100 includes a zipper engagement portion 110 composed of a zipper connection member 111 that a wearer wears on the waist and a zipper portion 112 engaged with the lower end portion of the zipper connection member 111 in the length direction, and a slider 120 having a lower side attached to the carrier pack main body portion 600 and an upper side engaged with the zipper portion 112 to slidably move along the zipper portion 112.

Here, since the sliding device 100 has the same construction and function as the sliding device 100 according to the first embodiment of the present invention, the same constituent reference numerals are used, and the duplicate explanation thereof will be omitted.

On the other hand, a connector 610 is provided on the upper portion of the carrier pack main body portion 600, and an attachment hook 620 coupled to the connector 610 is provided on the upper side portion of the zipper connection member 111.

In this case, a plurality of attachment hooks 620 is formed on the zipper connection member 111, and the carrier pack main body portion 600 is fixed to a specified position of the zipper connection member 111.

If the carrier pack main body portion 600 having the above-described construction is pulled to the left or right in a state where a wearer wears the zipper connection member 111 on the wearer's waist, The slider 120 attached to the carrier pack main body portion 600 slides to the left or right along the zipper portion 112, and the carrier pack main body portion 600 is rotated. In this case, if the connector 610 and the attachment hook 620 provided on the zipper connection member 111 are coupled to each other, the carrier pack main body portion 600 is fixed.

According to the belt back pack type carrier 40 according to the fourth example of the second embodiment of the present invention, the carrier pack main body portion 600 can be slidably moved to the front of the wearer without untying the whole carrier main body portion 600, and thus the user's convenience can be increased.

While this invention has been described in connection with what is presently considered to be the most practical and preferred embodiments, it is to be understood that the invention is not limited to the disclosed embodiment and the drawings. On the contrary, it is intended to cover various modifications and variations within the spirit and scope of the appended claims.

The invention claimed is:

1. A carrier comprising:

a carrier main body portion constructed to accommodate goods or a baby therein;

a shoulder strap attachment portion comprising a shawl plate, the carrier main body portion coupled to the shawl plate at one surface thereof, and a shoulder strap attached to the other opposite surface of the shawl plate; and a sliding device comprising:

a zipper connection member;

a zipper portion in which zippers are successively engaged with each other in a length direction of the zipper connection member; and a slider engaged with the zipper portion to slidably move along the zipper portion, wherein the sliding device makes the carrier main body portion coupled to the shoulder strap attachment portion so that the carrier main body portion is slidably moved around the shoulder strap attachment portion.

2. The carrier according to claim 1, wherein the slider comprises a slider main body engaged with the zipper portion to slidably move along the zipper portion, and a slider connection member engaged with a lower end portion of the slider main body.

3. The carrier according to claim 2, wherein one or two or more sliders are formed.

4. The carrier according to claim 1, wherein the zipper connection member is provided with an attachment hook having one end portion provided with a connector and the other end portion engaged with the connector.

5. The carrier according to claim 2, wherein the zipper connection member or the slider connection member is formed of any one of soft materials including cloth, leather, and synthetic resin.

6. The carrier according to claim 1, wherein the carrier main body portion comprises a carrier main body and a carrier attachment plate coupled, at one surface thereof, to the carrier main body.

7. The carrier according to claim 1, wherein a slider of the sliding device is attached to the carrier main body portion, and a zipper connection member of the sliding device is attached to the shoulder strap attachment portion.

8. The carrier according to claim 7, wherein the zipper connection member has a structure in which one side of the zipper connection member is attached to one surface of the shoulder strap attachment portion and the other side extends to the other surface of the shoulder strap attachment portion through a side direction of the shoulder strap attachment portion.

9. The carrier according to claim 1, wherein the carrier main body portion and the shoulder strap attachment portion are attached through an upper attachment hook portion and a lower attachment portion, the upper attachment hook portion comprises a connector provided on an upper portion of the carrier main body portion and an attachment hook provided on an upper portion of the shoulder strap attachment portion and coupled to the connector, and the lower attachment hook portion comprises a connector provided on a lower portion of the carrier main body portion and an attachment hook provided on a lower portion of the shoulder strap attachment portion and coupled to the connector.

10. The carrier according to claim 1, wherein a fixing member for hook-fixing both end portions of the zipper connection member is formed on the shoulder strap, and the fixing member comprises a locking hook formed on one side of the shoulder strap and hooked on an end portion of the zipper connection member to fix the end portion of the zipper connection member, and a fixture formed on the other side of the shoulder strap to fix the end portion of the zipper connection member in a state where the end portion of the zipper connection member is penetratingly inserted into the fixture.

* * * * *